United States Patent [19]

Hamada

[11] 4,306,497

[45] Dec. 22, 1981

[54] DOT MATRIX TYPE PRINTER

[75] Inventor: Kaoru Hamada, Tokyo, Japan

[73] Assignee: Nippon Electric Company, Ltd., Tokyo, Japan

[21] Appl. No.: 55,476

[22] Filed: Jul. 6, 1979

[30] Foreign Application Priority Data

Jul. 14, 1978 [JP] Japan ..... 53-86269

[51] Int. Cl.[3] ..... B41J 3/12

[52] U.S. Cl. ..... 101/93.05; 400/124; 248/559

[58] Field of Search ..... 400/121, 124, 166, 167; 101/93.09, 93.04, 93.05, 93.02; 248/559; 188/1 B

[56] References Cited

U.S. PATENT DOCUMENTS

| | | | |
|---|---|---|---|
| 3,288,419 | 11/1966 | Wallerstein | 188/1 B X |
| 3,322,379 | 5/1967 | Flannelly | 248/559 |
| 4,127,334 | 11/1978 | Watanabe et al. | 400/124 |
| 4,227,455 | 10/1980 | Pennebaker | 101/93.05 |

*Primary Examiner*—Paul T. Sewell

*Attorney, Agent, or Firm*—Claude A. S. Hamrick

[57] ABSTRACT

An improved dot matrix type printer including a carriage mechanism for a printer head having a plurality of printer elements aligned immediately before a platen adapted to carry a sheet of paper to be printed and along a direction parallel to the axis of the platen, the carriage mechanism comprising a balancing mass, a first resilient member which is adapted to connect the balancing mass to the printing head, and a second resilient member which is adapted to connect the balancing mass to a base structure member.

5 Claims, 19 Drawing Figures

DOT MATRIX TYPE PRINTER

Prior Art Known to Applicant

U.S. Pat. No. 3,332,343
U.S. Pat. No. 3,433,153
U.S. Pat. No. 3,797,387
U.S. Pat. No. 3,833,891
U.S. Pat. No. 3,994,219
U.S. Pat. No. 4,044,668

BACKGROUND OF THE INVENTION

This invention relates to a dot matrix type printer and, more particularly to improvement of its carriage mechanism including a printer head which comprises a plurality of printer elements aligned in the direction across a sheet of paper set on the platen of the printer to be printed.

The printer of this class is able to perform high speed operation to print various kinds of characters, so that it has become more popular to use the printer as an output means for systems such as a computer or the like.

As is known well, the printing speed of such a printer is basically determined by two factors. One is a period required for one reciprocation of the printer head and the other is a period required for repetitive printing motion of printer elements which are aligned in parallel with each other on the printer head. For realizing high speed operation, therefore, it is needed to shorten such two kinds of periods. It should be noted, however, that the printer head contains a lot of parts for constituting itself, thus resulting in a considerably large inertia when moving. Accordingly, the more speedily the printer is operated, the more often undesirable vibration is caused and the larger noise becomes also. The problem of high speed operation of the printer might be improved to some extent when generation of vibration and noise during the operation is satisfactorily suppressed by some means. If such is done well, however, there should still be problems, for instance the problem of protecting wear of parts which are working in slidable and rotating mechanism, the problem of maintaining such parts and others in good condition and so forth. High speed operation naturally causes high speed wear of parts, thus demanding more frequent maintenance work of inspecting and lubricating the mechanism and of repairing or replacing parts worn. To realize high speed operation by relying on the prior art carriage mechanism, it is needed to use a lot of sliding and rotating parts. This causes difficulties not only in miniaturizing the carriage mechanism but also in doing fine adjustment of the mechanism as well as maintanence of the same.

SUMMARY OF THE INVENTION

Accordingly, an object of the present invention is to provide a dot matrix type printer which is dynamically balanced well by absorbing vibration resulting from an inertia caused by reciprocation of the printer head.

Another object of the invention is to provide a dot matrix type printer wherein there is effectively suppressed the noise that has been generated in high speed printing operation thus far and also, wherein number of parts to be worn is reduced as many as possible to avoid frequent maintenance work such as the work for lubrication with a short interval.

Still another object of the invention is to provide a dot matrix type printer wherein a driving mechanism including a printer head is effectively minaturized and also is dynamically balanced well to enable the printer to perform high speed operation.

For achieving objects above, according to the present invention, there is provided a dot matrix type printer of the class wherein there is provided a carriage mechanism including a printer head which comprises a plurality of printer elements aligned immediately before a sheet of paper set on the platen to be printed and in the direction across said a sheet of paper, characterized in that said carriage mechanism has a balancing mass, a first resilient member which is adapted to connect said balancing mass with said printer head, and a second resilient member which is adapted to connect said balancing mass with a base structure member.

The invention will be more fully understood from the following description made by referring to the accompanying drawings.

DESCRIPTION OF THE PREFERRED EMBODIMENT

Figure 1:
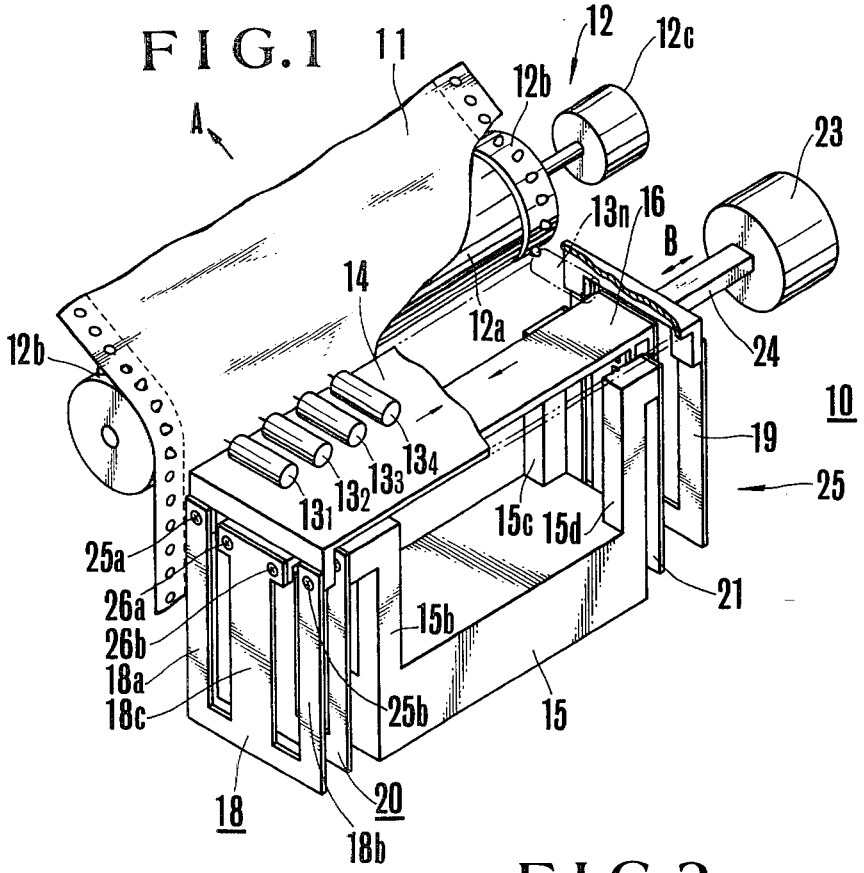
FIG. 1 is a perspective view of the essential part of the dot matrix type printer embodying the present invention, in which partial breaking away is done for showing the inside of the structure.

FIG. 1 shows an embodiment of the present invention and, especially, shows the essential part of the printing mechanism with which the present invention is directly concerned. In the figure, the entire printer is designated by a reference numeral 10 and has a paper-feeding mechanism 12 which comprises a platen 12*a* for use in sending out a sheet of paper or a paper roll being set thereon, a pair of pin feed tractors 12*b* disposed at both ends of said platen and a paper-driving motor 12*c* for driving said platen and tractors. A pair of pin feed tractors are, as is known well, made slidable along the axis of the motor 12*c* to adjust the distance therebetween to meet the width of the paper to be set on the platen. The pins are arranged at predetermined intervals along the circumference of the tractor and mate with corresponding holes formed along both sides of the paper 11. Rotation of tractors causes the printed document to be moved in the direction shown by the arrow A in FIG. 1.

The printer 10 further contains a carriage assembly which comprises a slender, plate-shaped printer head 14 on which a plurality of printer elements $\mathbf{13}_l$ through $\mathbf{13}_n$ are mounted; a base structure 15 having four legs 15*a* through 15*d*, each of which has an inverted L-shape and extends upwardly from the base structure 15; a slender balancing mass 16 which is disposed under said printer head 14 so as to intervene between the legs 15*a* and 15*b* as well as legs 15*c* and 15*d*, and is provided with a mass matching the printer head; first plate springs 18 and 19 which are formed in an E-shape and form a connection between the printer head 14 and the balancing mass 16; second plate springs 20 and 21 which form a connection between the balancing mass 16 and the base structure 15; a driving source 23 which is adapted to reciprocate the printer head 14 in the direction across (perpendicular to, in this example) the direction of movement of the paper 11; and a connecting member 24 connecting the driving source 23 and the printer head 14.

In the example of FIG. 1, an ink ribbon (not shown) is disposed between the carriage assembly 25 and the paper feeding mechanism 12. Printer elements $\mathbf{13}_l$ through $\mathbf{13}_n$ are aligned on the printer head 14 keeping an equal interval therebetween. The printer elements 13 are of the dot type each having a single impact wire capable of causing dots to be printed on the paper 11 and a driving means such as a solenoid which is adapted to drive the wire back and forth. When a signal is input to the solenoid from a driving circuit (not shown), the wire is driven out toward the paper 11 to mark one dot thereon with the help of an ink ribbon (not shown) disposed between the head 14 and paper 11.

The head driving source 23 comprises a cam, a linear motor and so forth, and it reciprocates the printer head 14 through the connecting member 24 in the direction perpendicular to the paper feeding direction (i.e., the direction from the right to the left or vice versa). The span of reciprocation of the printer head 14 is designed to be nearly equal to the interval between the printer elements 13.

Figure 2:
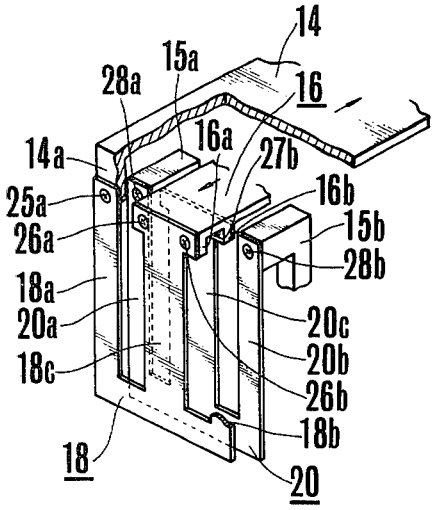
FIG. 2 is a perspective view of a part of the printer head in FIG. 1 to show in detail relationship among the printer head, the balancing mass, the securing member and the first and second resilient members to connect the three above.

Now, the relationship among the printer head 14, the balancing mass 16 and the base structure 15, which are features of the invention, will be described in detail by referring to FIG. 2. First, the relationship between the printer head 14 and the balancing mass 14 will be explained in connection with the first plate spring 18 which forms a connection therebetween. The printer head 14 has an end portion which is bent downwardly and has its center portion cut away so as to permit the balancing mass 16 to move therethrough in the longitudinal direction thereof. The remaining bent-down portions 14*a* are connected to the tips of the outer legs 18*a* and 18*b* of the first plate spring 18 using an appropriate connecting member such as screws 25*a* and 25*b*. The tip of the center leg 18*c* of the inverted E-shaped spring 18 is connected to a downwardly extending portion 16*a* formed at the left end of the balancing mass 16 by using screws 26*a* and 26*b*. Accordingly, movement of the printer head in a lateral direction, toward the left for instance, is initially transmitted to the center leg 18*c* through the outer legs 18*a* and 18*b* and then eventually to the balancing mass 16.

Another plate spring 19 is provided at the other end and acts between the printing head 14 and the balancing mass 16 in the same manner as the first plate spring 18.

The relationship between the balancing mass 16 and the base structure 15 will now be discussed in connection with the second plate spring 20. The balancing mass 16 is provided with a projection 16*b* extending downwardly from a portion which is at a distance inwardly from the projection 16*a*. This projection 16*b* is connected with the center leg 20*c* of the inverted E-shaped second plate spring 20 by using screws 27*a* (not shown) and 27*b*. The outer legs 20*a* and 20*b* of the second plate spring 20 are firmly connected to the ends of legs 15*a* and 15*b* of the base structure 15, which extend in the longitudinal direction of the balancing mass 16, by means of screws 28*a* and 28*b*. With this structure, the movement of the balancing mass 16 in one direction, toward the left for instance, is transmitted first to the center leg 20*c* of the spring 20 and finally to the base structure 15 through legs 20*a* and 20*c*. Another plate spring 21 (FIG. 1) is also provided and acts between the balancing mass 16 and the base structure 15 in the same fashion as the second plate spring 20.

Figures 3A, 3B:
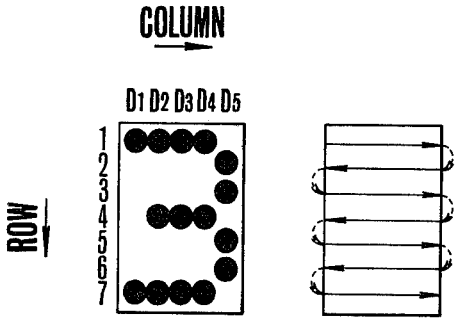
FIGS. 3A and 3B show the dot formation for printing for use in the printer shown in FIG. 1 and movement of the printer head in printing operation respectively.
Figure 4:
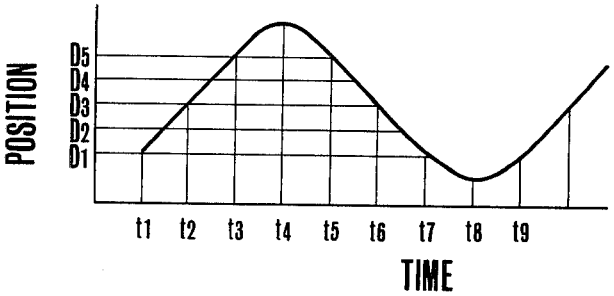
FIG. 4 is a diagrammatical representation to show relation of the time vs. printer head position in its reciprocation.

Operation of the embodiment will now be explained in connection with FIGS. 3 through 8. In the following explanation, it is assumed that the printer is caused to operate in a 5×7 matrix mode, i.e., one print character area consists of 5 horizontal columns of 7 vertically arrayed dot positions. In accordance with this type of matrix mode, a numeral "3" is written as shown in FIG. 3A in the form of a particular dot group. This dot group is formed by reciprocating or scanning (hereinafter these terms are used interchangeably) the printer head 14 such that each element is caused to move relative to a print character area in the manner shown in FIG. 3B. More particularly, the printer head 14 starts at a left most position such that the impact wire of each printing element is positioned at the left end of the first line of the corresponding character area and travels horizontally to the right to a right-most position and then changes its travelling direction at the right end of the first line of the character area to travel through the section line of the character area from the right to the left thereof, and further it changes its travelling direction once again at the end of its second travel on the second line to enter into its third travel on the third line of the character area from the left to the right thereof. The printer head repeats the same movement as above until a scan over the entire character area is completed.

During the movement of the printer head as described above, the printer element is actuated whenever it arrives at a position where printing is to be done, thereby causing a character such as the numeral "3" in this instance, to be printed. The printing operation mentioned above will be more fully understood from the following explanation taken in conjunction with FIG. 4 which shows the relation between time and printer head position as it changes according to time. At the time t1 the printer element of the printer head 14 is at the position D1 which corresponds to the dot at the left-most upper corner of FIG. 3A. When time changes to t2 and then, to t3, the printing element moves to the right to take the positions D2, D3 and D4, and then reaches the position D5 at the time t3.

The numeral "3" as shown in FIG. 3 is printed through the following process. On the first line, dot printing is carried out at each of positions D1 through D4 but not at the position D5. Then, the printing head 14 is quickly turned by the driving source 23 to get back to the position D5 again at the time t5. During this period, the paper-feeding motor 12*c* acts to move the paper 11 upwardly by one line interval, with the printer head 14 being placed at the right end of the second line. Then, the printer head is made to travel to the left along the second line and arrives at position D1, i.e., the left end of the second line as shown in FIG. 3B, at the time t7. During this travel of the printer head, dot printing is executed at D5 but not at any of D4 through D1. In a manner like that mentioned above, the printer head repeats its traveling over the several lines to complete the scanning as shown in FIG. 3B, during which dot printing is executed at desired positions to write a desired character, "3" in this instance.

In the course of the above-mentioned printing operation, constituents featured in the present invention act as follows. At the middle point in the movement of the printer head 14, i.e., at D3 in FIG. 4, the pair of plate springs 18 and 19, and another pair of the same 20 and 21, come into a natural stand still state. In other words, the plate springs become parallel to one another.

Figure 5:
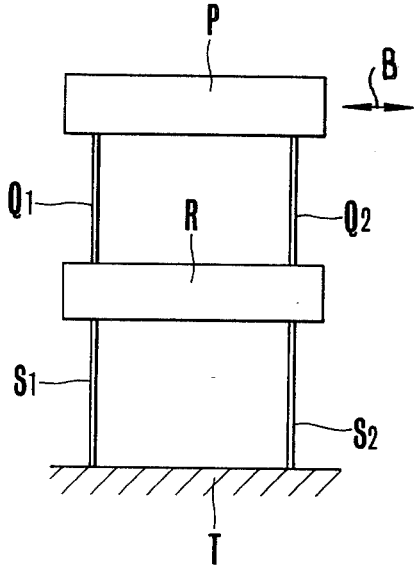
FIG. 5 is a diagrammatical representation for use in explaining the principle of operation of the printer shown in FIG. 1.

The basic idea of the present invention will now be easily understood from the following explanation made by referring to FIG. 5 which is a schematic diagram showing only the essential elements. In the figure, a character P represents a moving body such as the printer head 14 including printer elements $13_l$ through $13_n$ in the above-mentioned embodiment while the character R represents a balancing mass like the balancing mass 16 in the foregoing embodiment. Characters Q1 and Q2 designate resilient members, the opposite of which are respectively affixed to the moving body P and the balancing mass. The characters S1 and S2 likewise indicate resilient members, the opposite ends of which are respectively affixed to the balancing mass R and the base T. Q1 and Q2 correspond to the plate springs 18 and 19 in the embodiment above and constitute the first resilient system whereas S1 and S2 are equivalent to plate springs 20 and 21 and constitute the second resilient system.

In the following, it is assumed that the moving body P and the balancing mass R are made to be equivalent to each other from the mass standpoint and that the first and second resilient members Q1 and Q2, S1 and S2 are provided with identical spring constants. Under this condition, when the moving body P is driven by a driving means like the driving source 23 in FIG. 1 and caused to reciprocate in the direction as indicated by the dual head arrow B (FIG. 1), and receives an external force expressed as $F=X_0 \sin \omega ot$, where $X_0$ represents a scanning amplitude and $\omega o$ an angular velocity, both the first resilient system fixed to the moving body P and the second one fixed to the balancing mass R start vibrating at an identical proper frequency $\omega$. In other words, if two bodies having an equivalent mass (the moving body P and the balancing mass R, in this instance) are moved in phase and opposite to each other, they will appear to be standing still when observed from a base T. Accordingly, if the scanning frequency is selected to be equal to the proper frequency of the first and second resilient system, it should be possible to completely absorb the vibration that is caused when the moving body P is speedily moved or quickly turned for scanning purposes.

In the following, the above discussion will be further developed by referring to FIGS. 6 through 8 as well as by giving specific values to the moving body P, the balancing mass R, and the first and second resilient members. Now, letting the respective mass of the moving body P and the balancing mass be 600 g; the spring constant of the resilient members Q1 and Q2, and S1 and S2 be 1.279 kg/mm; and the scanning amplitude X0 of the moving body P be 3.14 mm, if the moving body P is scanned with the force $F=X_0 \sin \omega ot$, characteristics as shown in FIGS. 6 through 8 will be attained in respect of the moving body P and the balancing mass R.

Figure 6:
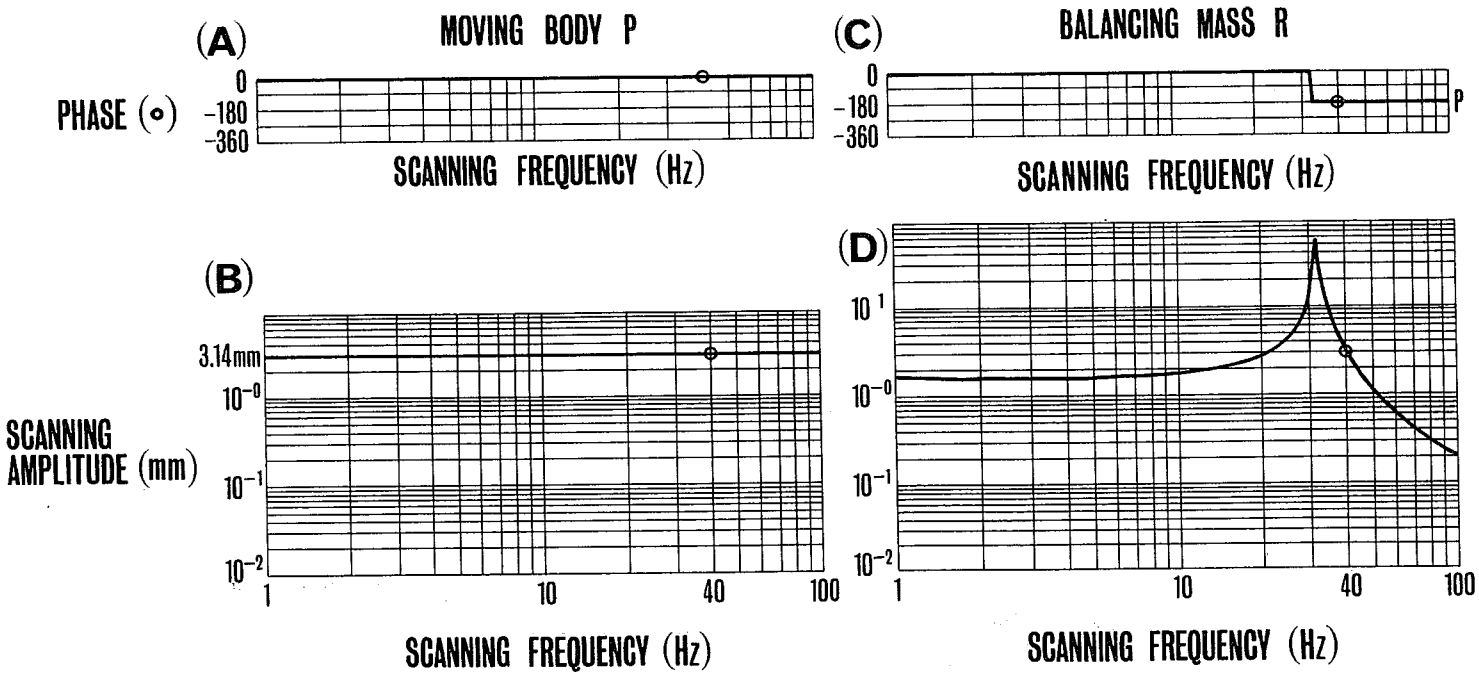
FIGS. 6A and 6B are graphs showing phase and amplitude characteristics relative to the reciprocating frequency of a prototype moving body (printer head) P.
FIGS. 6C and 6D are graphs showing phase and amplitude characteristics relative to the reciprocating frequency of a prototype balancing mass R.

In FIG. 6, the left side graphs show the phase-scanning frequency characteristic as well as the scanning amplitude frequency characteristic of the moving body P where the scanning amplitude is constant at 3.14 mm and the phase is zero. The right side graphs show corresponding characteristics of the balancing mass R in respect to the phase and scanning amplitude.

Figure 7:
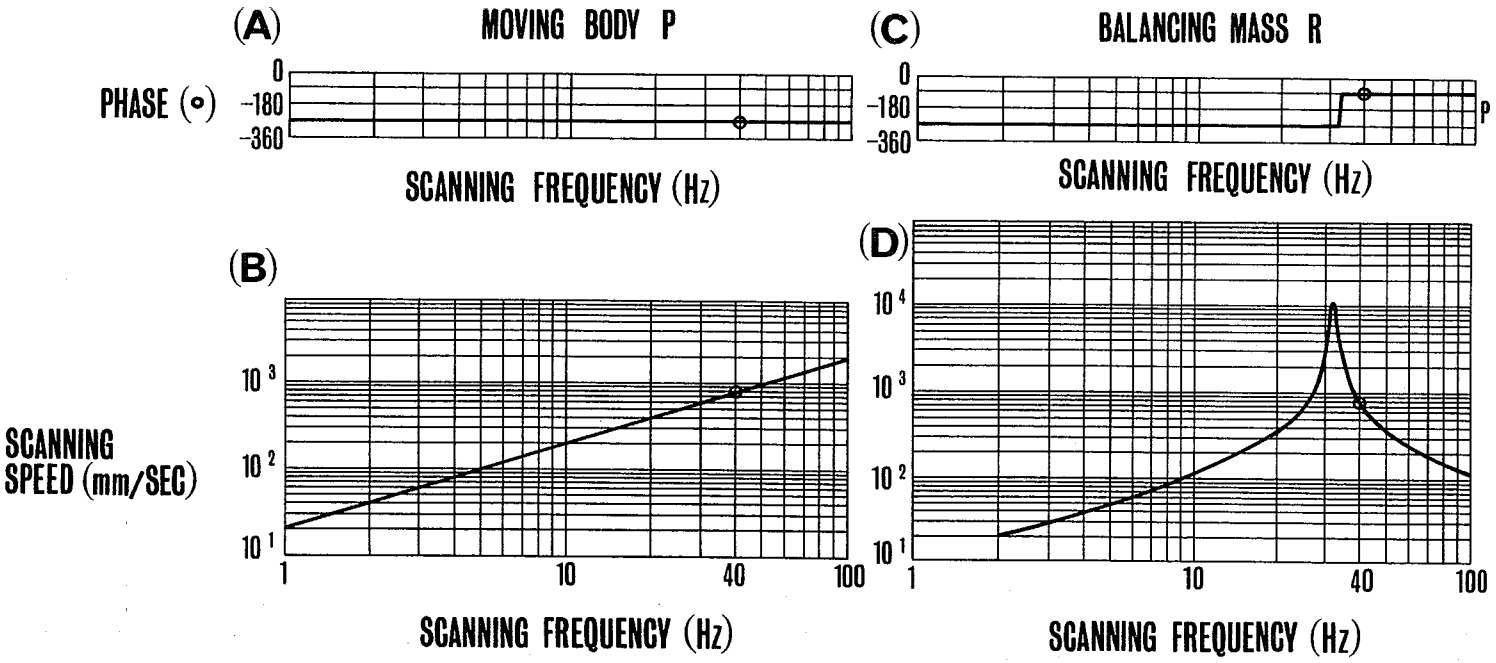
FIGS. 7A and 7B are graphs showing phase and reciprocating speed characteristics relative to the reciprocating frequency of the prototype moving body P.
FIGS. 7C and 7D are graphs showing phase and reciprocating speed characteristics relative to the reciprocating frequency of the prototype balancing mass R.

In FIG. 7, the left side graphs show the phase-scanning frequency characteristic as well as the scanning speed-frequency characteristic of the moving body P. The right side graphs show the corresponding characteristics of the balancing mass in respect to phase and scanning speed.

Figure 8:
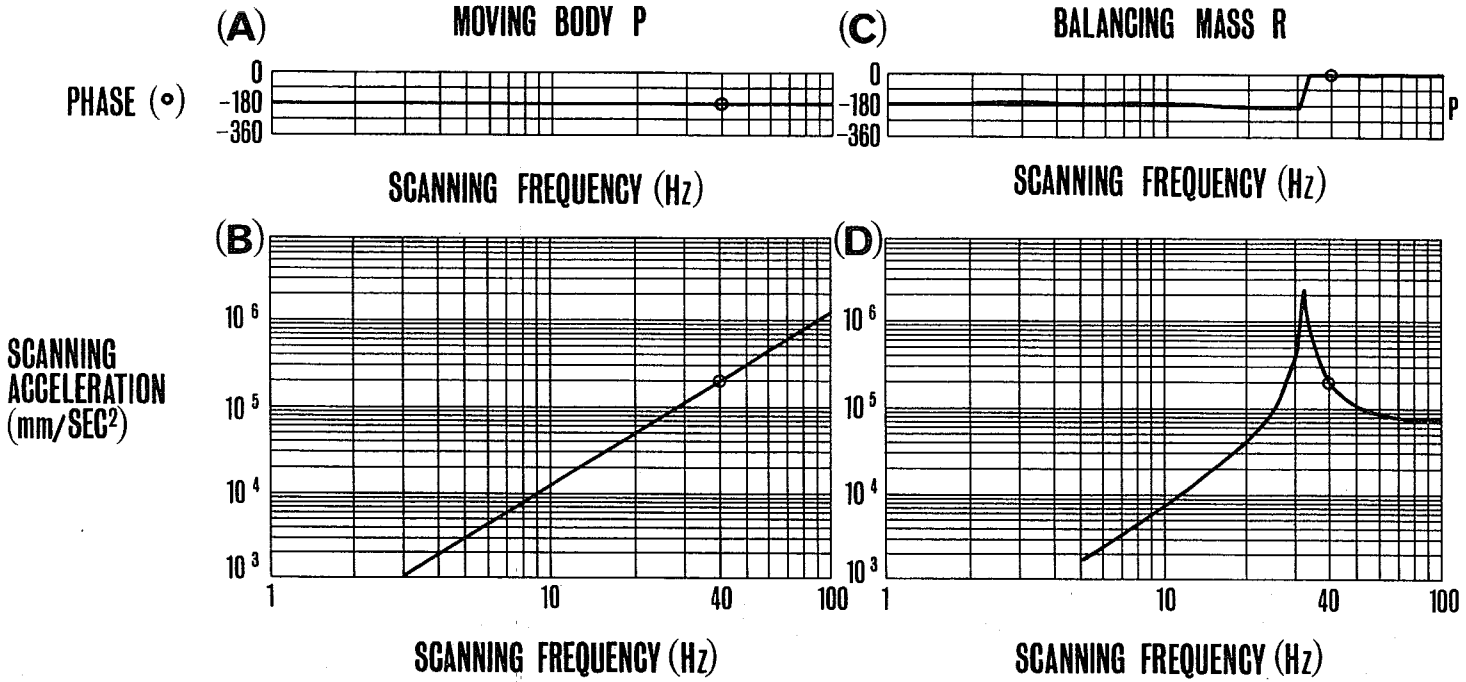
FIGS. 8A and 8B are graphs showing phase and reciprocating acceleration characteristics relative to the reciprocating frequency of the prototype moving body P.
FIGS. 8C and 8D are graphs showing phase and reciprocating acceleration characteristics relative to the reciprocating frequency of the prototype balancing mass R.

In a similar manner, phase-scanning frequency and scanning acceleration frequency characteristics are shown relative to the moving body P and the balancing mass corresponding thereto in FIG. 8.

In FIGS. 6 through 8, it should be noted that 40 Hz is a very significant frequency, because at this frequency the moving body P and the balancing mass R have an identical value as to their scanning amplitude, speed and acceleration but they are in opposite phase. This means that they are in a relatively stabilized condition.

Note that 40 Hz is equal to the frequency that is attained by multiplying the proper frequency of the first and second resilient members Q1 and Q2, and S1 and S2 by $\sqrt{3}$.

Furthermore, in FIGS. 6 through 8, it will be also noted that the balancing mass R must have a resonance point before coming into a stabilized state where the frequency has a value given by multiplying the proper frequency by $\sqrt{3}$. This resonance point corresponds to the point where the phases of the moving body P and the balancing mass R are turned from the identical state to the opposite, and it often results in abnormal vibration of the moving body P. This is seen as to the printer head of the actual printer.

In the following, there will be explained another embodiment that is modified relative to the embodiment shown in FIG. 1 so as to eliminate negative effects caused by the resonance phenomenon.

Figure 9:
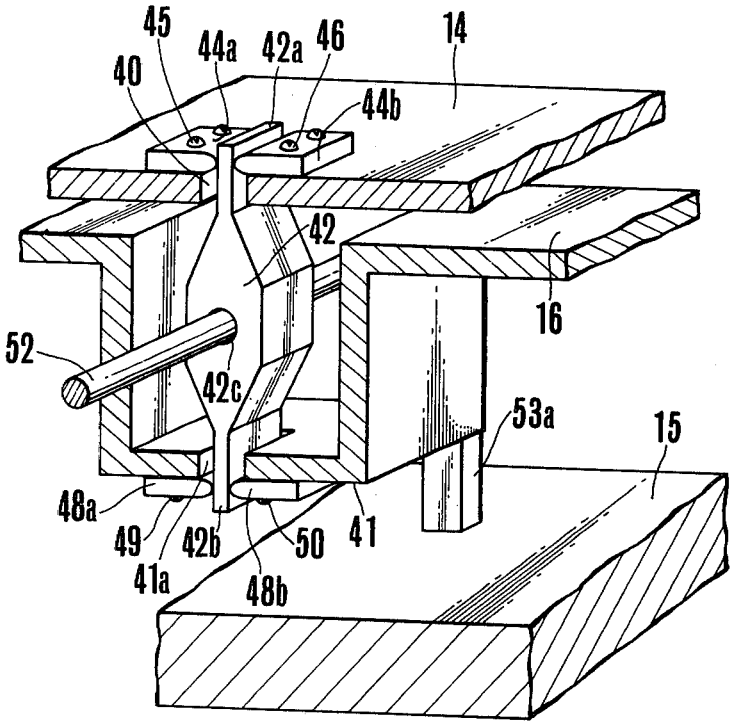
FIG. 9 is a perspective view of the essential part of the printer which is modified from the embodiment in FIG. 1.

FIG. 9 shows the second embodiment of this invention but it shows only those features which must be added to the first embodiment shown in FIG. 1. Therefore, like parts or similarly functioning parts have like reference numerals or symbols. In the figure, the printer head 14 carrying printing elements thereon is provided at its center with a slender rectangular hole 40 which is formed having its longer side in the direction perpendicular to the longitudinal direction of the printer head. The balancing mass 16 is provided at its center portion with a pit 41 which is formed facing toward the rectangular hole 40. At the bottom of the hole 40, there is provided another rectangular hole 41*a* which is directly opposite hole 40.

The printing head 14 and the balancing mass 16 are swingingly connected to each other through a connecting lever 42 and the plate springs 18 and 19. The end 42*a* of the connecting rod 42 has a rectangular cross sectional dimension which is a little smaller than that of the rectangular hole 40 on the printer head 14, and the end 42*a* penetrates the hole 40 to project above the upper surface of the printer head 14. This projected portion is held in place by a pair of resilient rubber members 44*a* and 44*b*. The ends of the rubber members 44*a* and 44*b* which abut against the connecting lever end are rounded so as to allow the lever 42 to easily swing. Rubber members 44*a* and 44*b* are connected with the printer head 14 at their other ends by screws 45 and 46. In a similar manner, the other end 42*b* of the connecting lever 42 has a rectangular cross section, the dimensions of which are a little smaller than that of the rectangular hole 41*a* formed at the bottom of the pit 41, and penetrates through the hole 41*a* to project out of the pit 41. The projected portion is also held by another set of resilient rubber members 48*a* and 48*b*. The ends of the rubber members 48*a* and 48*b* which abut against the other end 42*b* of the lever 42 are rounded so as to permit the lever 42 to easily swing. The other ends of the rubber members 48*a* and 48*b* are secured to the bottom of the pit 41 by screws 49 and 50.

The connecting lever 42 is provided at its center portion with a penetrating hole 42*c* which is formed in parallel with the longer side of the rectangular holes 40 and 41*a*, and through which a shaft or axle 52 is disposed to penetrate. The axle 52 is fixed and spans between a pair of supporting means 53*a* and 53*b* (53*b* is not shown) standing upright from the base structure 15.

With this structure, the connecting lever 42 effectively works to force the printing head 14 and the balance mass 16 to swing each other in opposite phase with respect of the fixed axle 52.

Accordingly, when the printing head is driven to reciprocate, it has to pass through the resonance point before it gets in the stabilized state where the frequency is equal to three times the proper frequency. However, the connecting lever 42 causes an opposite phase motion by the printer head 14 and the balancing mass 16, thus obviating defects such as the generation of abnormal printer vibration which is sometimes observed in other printer embodiments.

The most stabilized state is realized when the scanning frequency becomes $\sqrt{3}$ times the proper frequency. It should be considered, however, that the scanning frequency might be still influenced by other factors such as the resistance generated during the dot printing by a plurality of printing elements. In this case, the connecting lever 42 still acts effectively to suppress such bad influences because it can provide the printer head and the balancing mass with a swinging motion in opposite phase, thus enabling a stable high speed reciprocation.

As discussed above, according to the present invention, there is provided a printer head mechanism which includes less impact portions as well as less mating portions. Thus, noise and wear problems are reduced to a great extent, and lubrication becomes hardly necessary. Further, the scanning frequency is just $\sqrt{3}$ times the proper frequency of the resilient member, so that the driving source is only required to have enough force to overcome the printing resistance. Accordingly, the invention enables the printer head to perform high speed reciprocation without special maintenance and adjustment of the apparatus.

In the foregoing discussion, the resilient member has been explained in terms of an embodiment using a leaf or plate spring. It is apparent, however, that a coil spring or a rubber member or the like could realize the same function and effect as the plate spring. Naturally, in the case of the alternatives mentioned above, it might be necessary to modify the structure slightly but the essential structure as shown in FIG. 5 would be generally applicable to such modification. Any such modification could be easily carried out by one skilled in the art without departing from the basic spirit of the present invention.

Still further, in the discussion thus far, for easy understanding of the invention, certain limitations have been implied to the effect that the printer head and the balancing mass have an equivalent mass such that the spring constant of resilient member is identical. These limitations, however, are not essential. If the mass ratio is not like that of the embodiment above, it should be possible to attain the same effect as mentioned by approximating the proper angular velocity that is determined by the spring constant corresponding to the mass ratio to the external angular velocity of the driving source.

It should be noted that the present invention is not limited by embodiments described above and that various modifications can be considered without departing from the spirit of the present invention.

What is claimed is:

1. In a dot matrix type printer of the class wherein there is provided a carriage mechanism for carrying a printer head having a plurality of printer elements aligned immediately in front of a platen which is adapted to carry a sheet of paper to be printed, said carriage mechanism being reciprocatively movable relative to a base structure and along the axial direction of said platen, characterized in that said carriage mechanism comprises:

a balancing mass;

first resilient means adapted to connect said balancing mass to said printing head;

second resilient means adapted to connect said balancing mass to the base structure; and swinging means for forcing said printer head and the balancing mass to swing in opposite phase relation, said swinging means having a connecting lever which is made to pivot around a fixed axis, one end of said connecting lever being swingingly inserted into a first hole formed in the center of said printer head and the other end of said connecting lever being swingingly inserted into a second hole formed in the center of said balancing mass in facing relationship to said first hole.

2. In a dot matrix type printer as recited in claim 1, wherein said one end of said connecting lever is secured to said printer head by a pair of resilient members carried by said printer head and the other end of said connecting lever is secured to said balancing mass by a pair of resilient members carried by said balancing mass.

3. In a dot matrix type printer as recited in claim 2, wherein said pairs of resilient members are made of elastic material.

4. In a dot matrix type printer as recited in claim 1 wherein said first and second resilient means are comprised of generally E-shaped members the center-most appendages of which are connected to said balancing mass, the outer-most appendages of the E-shaped members forming said first means being connected to said printing head, and the outer-most appendages of the E-shaped members forming said second means being connected to said base structure.

5. In a dot matrix type printer of the class wherein there is provided a carriage mechanism for carrying a printer head having a plurality of printer elements aligned immediately in front of a platen which is adapted to carry a sheet of paper to be printed, said carriage mechanism being reciprocatively movable relative to a base structure and in the axial direction of said platen, characterized in that said carriage mechanism comprises:

a balancing mass;

first resilient means adapted to connect said balancing mass to said printing head; and second resilient means adapted to connect said balancing mass to a base structure member, said first and second resilient means cooperating with said balancing mass to support said printing head relative to said base structure, said first and second resilient means being comprised of generally E-shaped members the center-most appendages of which are connected to said balancing mass the outer-most appendages of the E-shaped members forming said first means being connected to said printing head, and the outer-most appendages of the E-shaped members of said second means being connected to said base structure.

* * * * *